United States Patent [19]

Notta et al.

[11] 4,272,861

[45] Jun. 16, 1981

[54] CARPET CLEANING DEVICE

[75] Inventors: Adolf Notta; Ian A. Scovell, both of Youngstown, N.Y.

[73] Assignee: Wetrok, Inc., Niagara Falls, N.Y.

[21] Appl. No.: 79,960

[22] Filed: Sep. 28, 1979

[51] Int. Cl.[3] ..... A47L 11/12; A47L 11/202

[52] U.S. Cl. ..... 15/320; 15/322; 15/368; 15/381

[58] Field of Search ..... 15/321, 322, 368, 381, 15/320

[56] References Cited

U.S. PATENT DOCUMENTS

| | | | |
|---|---|---|---|
| 1,878,914 | 9/1932 | Swartz | 15/381 |
| 2,997,730 | 8/1961 | Dierks | 15/368 |
| 3,871,051 | 3/1975 | Collier | 15/368 X |
| 4,014,067 | 3/1977 | Bates | 15/381 X |
| 4,136,420 | 1/1979 | Cyphert et al. | 15/381 X |
| 4,156,952 | 6/1979 | Lynch, Jr. | 15/381 X |
| 4,167,799 | 9/1979 | Webb | 15/322 X |

*Primary Examiner*—Christopher K. Moore
*Attorney, Agent, or Firm*—Christel, Bean & Linihan

[57] ABSTRACT

The carpet cleaning device of this invention includes a liquid application means, liquid removal means and carpet brushing means. A reciprocating motion is provided to a pivoted brush by means of a rotary shaft having an oblique crank portion carrying a bearing whose outer race is connected to the brush. The shaft axis, center line of the bearing, and the brush pivot axis all intersect at a common point thus transforming rotary motion of the shaft to an arcuate, reciprocating motion of the brush.

10 Claims, 7 Drawing Figures

CARPET CLEANING DEVICE

BACKGROUND OF THE INVENTION

1. Field of the Invention

This invention relates generally to carpet cleaning machines having suction means and carpet brushing means.

More specifically, this invention relates to a carpet cleaning machine having a reciprocating, carpet engaging brush driven by a mechanism which directly converts rotary motion to an arcuate, reciprocating movement.

2. Description of the Prior Art

A number of carpet cleaning devices utilizing a combination of suction means with a reciprocating, carpet engaging brush are known in the prior art. The brush itself is typically pivoted on arms and is reciprocated by action of an eccentric working through a connecting rod or cam means.

One such device is illustrated in U.S. Pat. No. 2,114,116 in which a shaft is eccentrically mounted in a belt-driven pulley and transmits reciprocating pivotal movement to an agitator or brush through a pin member operating in an arcuate cam way.

A more recent cleaning device combining a reciprocating brush with liquid cleaning means and suction pickup is shown by U.S. Pat. No. 4,014,067. In this device, a conventional eccentric operating through a connecting rod imparts a reciprocating action to a pivotally mounted brush.

It is also known to translate rotary motion into linear reciprocating motion utilizing a shaft having a crank portion set at an oblique angle to the shaft. One such device adapted for use in a reciprocating saw is illustrated in U.S. Pat. No. 2,824,455.

The translation of rotary motion to a reciprocating, arcuate movement by means of an eccentric introduces a considerable amount of vibration and noise into the operation of a machine. In addition, because of the stresses involved, an eccentric arrangement is inherently a high wear component.

SUMMARY OF THE INVENTION

A cleaning implement especially adapted for washing a floor fastened carpet comprises nozzle means for delivering a cleaning or rinse solution to a carpet area, reciprocating brush means to thoroughly contact the solution and carpet and vacuum pickup means to remove the solution from the carpet. The brush means is powered by a motor driving a shaft having a crank portion obliquely disposed relative to the shaft axis. Mounted on the crank is a bearing whose inner race rotates with the crank and whose outer race is fixedly mounted to a ring frame. The frame in turn connects to a brush carrying member pivoted at points along an axis which intersects the axis of the shaft and the center line of the bearing at a common point thus directly converting rotary motion of the shaft to arcuate reciprocating movement of the brush.

Hence, it is an object of this invention to provide a carpet cleaning device having an improved brushing means.

It is a specific object of this invention to provide means to drive the brush of a carpet cleaning device by translating rotary motion of a shaft directly to a reciprocating, arcuate movement of the brush.

DESCRIPTION OF PREFERRED EMBODIMENTS

Figure 1:
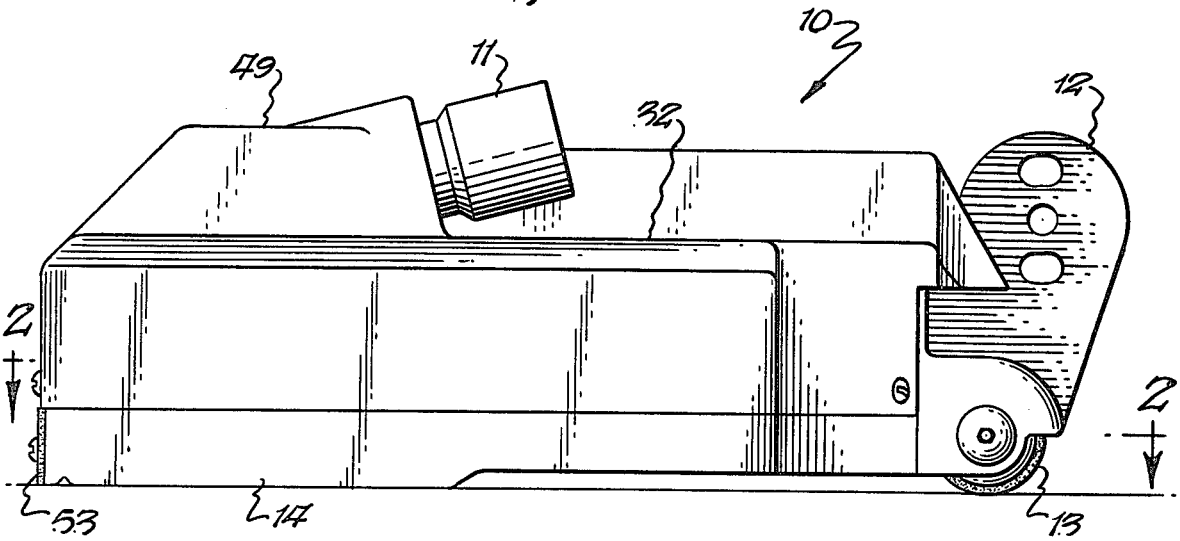
FIG. 1 is a side outline view of the cleaning device of this invention.

The invention will be described in reference to the drawing in which like numbers denote like parts throughout the figures.

The carpet cleaning machine of this invention is indicated generally by the numeral 10. Referring first to FIG. 1, the machine includes a vacuum hose connection 11, handle mount 12, roller 13 located generally beneath the handle mount and housing side plate 14.

Figure 2:
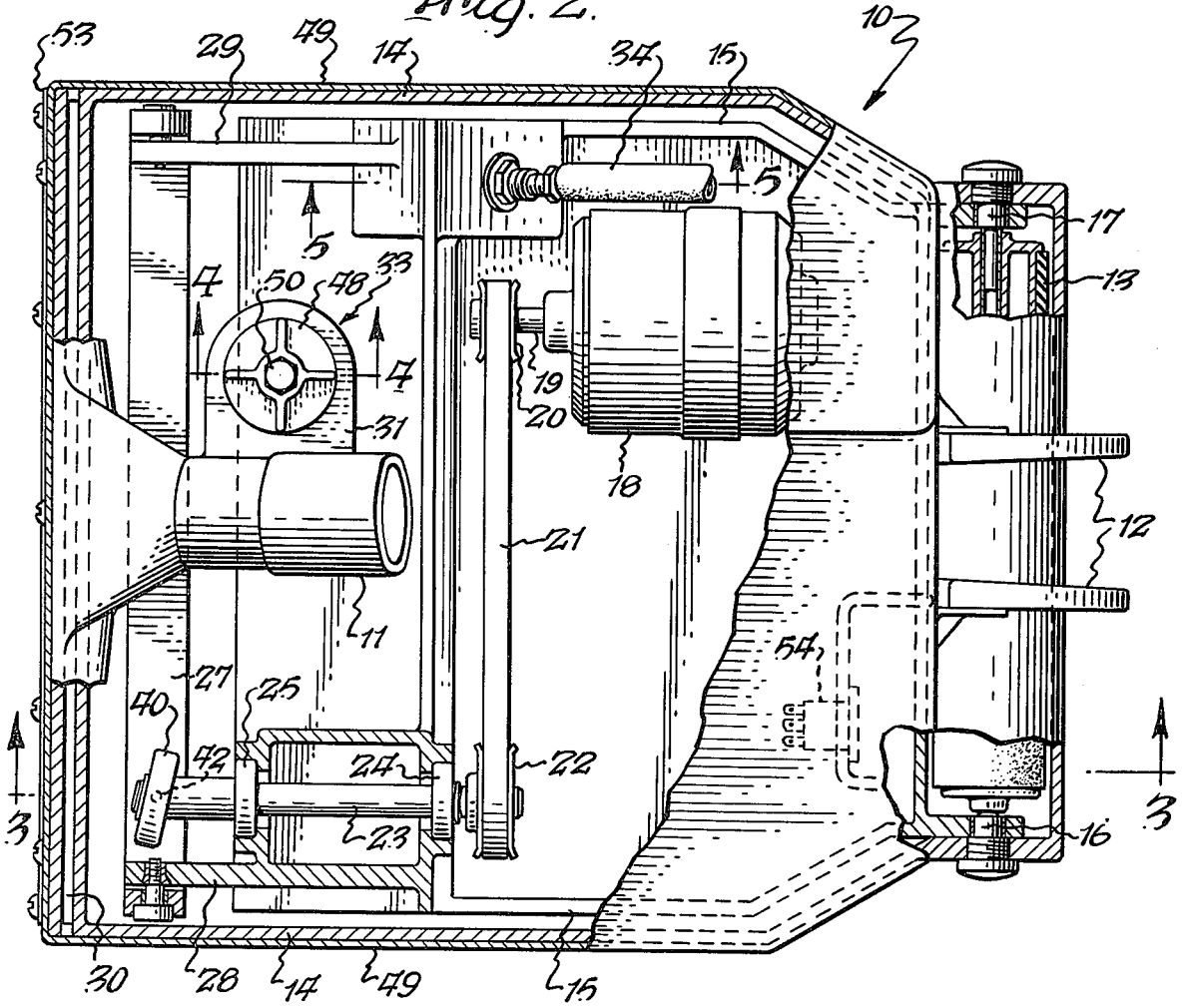
FIG. 2 is a partial sectional view taken along line 2—2 of FIG. 1.
Figure 3:
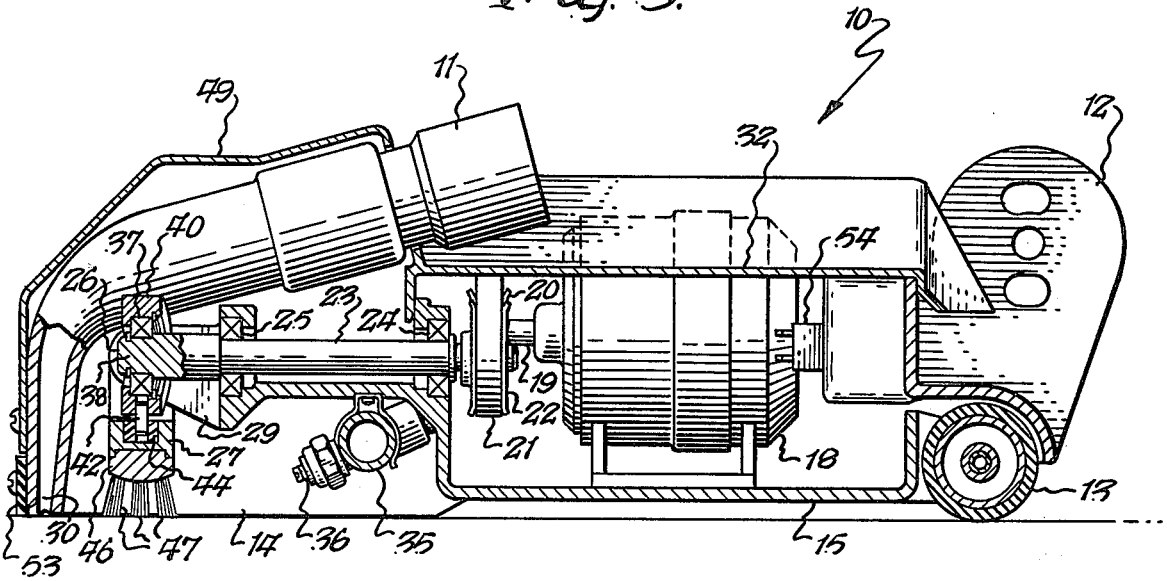
FIG. 3 is a partial sectional view taken along line 3—3 of FIG. 2.

As is shown in FIG. 2, there is provided a lower frame plate 15 which is pivotally mounted at the ends 16 and 17 of roller 13. Mounted on frame plate 15 is motor 18 having a shaft 19 with pulley 20 mounted thereon. The motor is connected by means of belt 21 and pulley 22 to drive shaft 23 which is rotatably mounted on frame plate 15 by means of bearings 24 and 25. Shaft 23 terminates in a crank portion 26 (best illustrated in FIGS. 6 and 7) disposed at an oblique angle relative to the shaft axis. Brush holder bar 27 is pivotally mounted on forwardly projecting ears 28 and 29 of frame plate 15.

Figure 4:
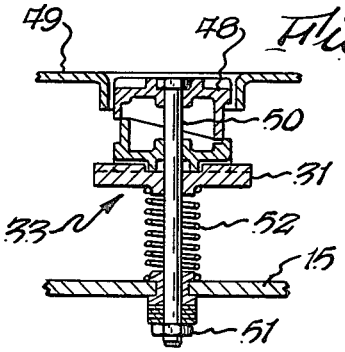
FIG. 4 is a sectional view of the brush height adjustment means taken along line 4—4 of FIG. 2.
Figure 5:
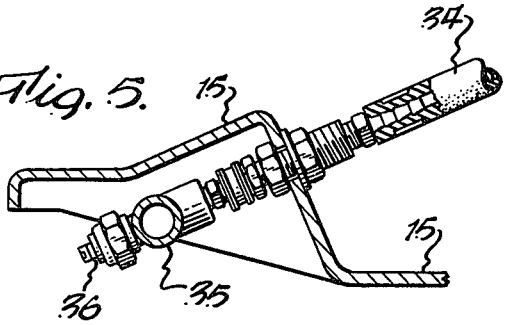
FIG. 5 is a sectional view along line 5—5 of FIG. 2 showing details of the cleaning fluid entry means.

Disposal transversely across the front of the machine just forward of the brush holder bar is vacuum head 30. Mounted at the top of the machine on a horizontal projecting lug 31 of upper frame member 32 is brush height controlling means 33 which is shown in greater detail in FIG. 4. Also mounted to frame plate 15 at one side thereof is liquid cleaning solution entry conduit 34 which terminates in a transversely extending manifold 35 having a plurality of downwardly directed spray nozzles 36. FIG. 5 presents a detailed view of the solution entry conduit, manifold and nozzle arrangement.

As before noted, drive shaft 23 terminates in a crank portion 26 which is disposed obliquely at a small angle, which may conveniently be on the order of 10 to 15 degrees, from the axis of the shaft. Mounted on crank portion 26 is a bearing 37 which is preferably of the ball type having an inner and an outer bearing race. The center line of bearing 37 intersects the axis of shaft 23 at a point 38 which point is also on a common axis with the pivot points of the brush holder bar 27. Bearing 37 is held in place on crank 26 by means of snap ring 39.

The inner race of bearing 37 rotates with crank 26 while the outer race is held stationary by means of ring plate 40 which circles the bearing and is held in place by snap ring 41. An upper end of connecting pin 42 is fitted in a bore 43 located at the bottom center of ring plate 40. The lower end of pin 42 fits into resilient bushing 44 carried by a socket 45 formed in brush holder bar 27. Bushing 44 is preferably fabricated of a urethane elastomer or like material and acts to substantially dampen any vibration and to reduce or eliminate noise created by or transmitted through the drive mechanism. In addition, the elastomeric nature of bushing 44 accommodates manufacturing tolerances of the connecting parts upon assembly.

Figure 6:
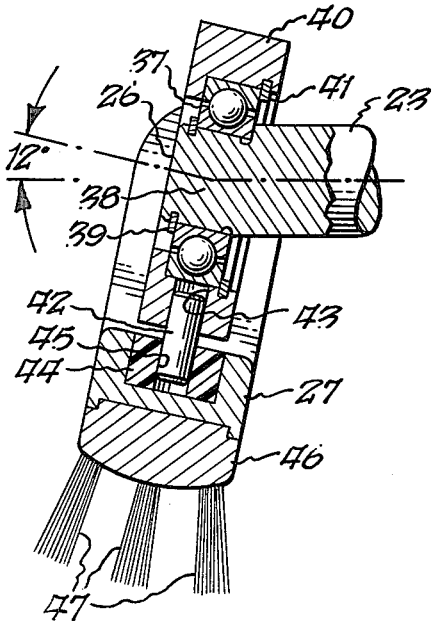
FIG. 6 illustrates the drive shaft and brush attitude at one extreme position.
Figure 7:
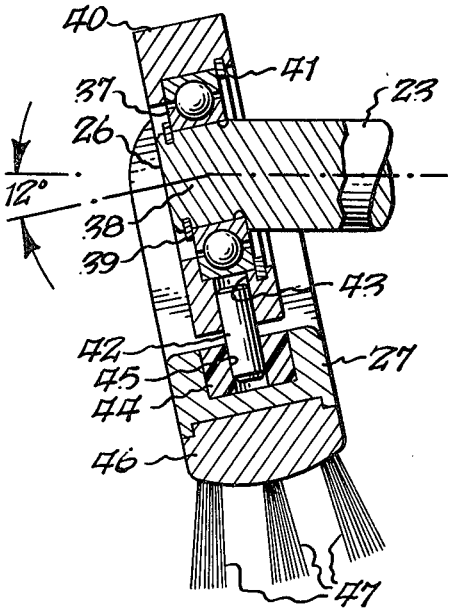
FIG. 7 illustrates the drive shaft and brush attitude at the opposite extreme position.

Operation of the brush drive means will be more clearly understood by reference to FIGS. 6 and 7. In this particular embodiment, the crank portion of shaft 23 is offset from the shaft axis at a 12° angle. FIG. 6 illustrates one extreme position of the brush means while FIG. 7 illustrates the opposite extreme position caused by rotation of shaft 23 through an angle of 180°. Pin 42, acting through ring plate 40, connects the outer race of bearing 37 to the brush holder bar 27 and brush bar 46 to form in effect an arm member pivoting about the intersection of the shaft axis and bearing center line. Crank 26, co-acting with the bearing, produces an arcuate oscillation which is confined to a vertical plane parallel to the shaft. Thus, the rotary motion of the shaft is translated into an arcuate, reciprocating movement of the brush.

Adjustment of the brush height to compensate for bristle (47) or to adapt to differing pile height of the carpet or rug being cleaned is accomplished by means 33. As is illustrated in FIG. 4, means 33 comprises an adjustment knob 48 which is recessed into appliance housing 49. Knob 48 is engageably connected to threaded bolt 50 which extends through lug 31 of upper frame member 32 and lower frame plate 15 and terminates in nut or locking means 51. Spring means 52 disposed around bolt 50 and between member 32 and plate 15. allows plate 15 to move relative to member 32 pivoting about roller 13 thus effectively changing the working height of the brush relative to the rug or carpet being cleaned.

Because the side plates 14 of housing 49 ride along the rug surface, the position of vacuum head 30 is unaffected by the brush height adjustment. Vacuum head 30 preferably includes on its forward side a rigid stainless steel squeegee 53 which aids in the efficient removal of cleaning liquid from the carpet. An electrical plug 54 is provided for connection to any convenient source.

As may now be appreciated, this invention provides a brush drive means of simplified construction which operates quietly with a minimum of vibration resulting in an improved overall efficiency of the carpet cleaning device..

What is claimed is:

1. In a carpet cleaning device having means to deliver a liquid cleaning or rinse solution to the carpet, suction pickup means to remove liquid from the carpet and oscillating brush means arranged to contact the carpet, the improvement comprising:

a drive shaft, means to rotate said shaft, means for converting rotation of said shaft to oscillation of said brush means including a crank portion of said shaft disposed at an oblique angle to the axis of said shaft, a bearing mounted on said crank portion, and means connecting said bearing to said brush means, said brush means comprising a transversely extending bar pivoted to oscillate in contact with the carpet, the pivot axis of said brush means, the center line of said bearing and the axis of said shaft substantially intersecting at a common point.

2. The device of claim 1 wherein the means connecting said bearing to said brush means comprises a ring plate attached to said bearing and having a bore at the bottom center thereof.

3. The device of claim 2 further comprising pin means insertable into said bore and connecting said ring plate with brush holding means.

4. The device of claim 3 further comprising a socket in said brush holding means and resilient bushing insertable into said socket, said pin means insertable into said bushing.

5. The device of claim 4 wherein the bushing comprises a urethane elastomer.

6. The device of claim 1 wherein said crank portion of said shaft is disposed at an angle in the range of about 10 to 15 degrees relative to the shaft axis.

7. The device of claim 1 further comprising means to adust the brush height relative to the carpet being cleaned.

8. The device of claim 7 wherein said brush height adjusting means comprising a lower frame member pivoted about wheel means disposed at one end of the cleaning device, said shaft and brush means being mounted on said lower frame member, an upper frame member, and means for moving said lower frame member relative to said upper frame member.

9. In a cleaning device for carpets and the like of the type having suction pickup means and oscillating brush means arranged to contact the carpet, the improvement comprising:

A drive shaft, means to rotate said shaft, said shaft having a crank portion disposed at an oblique angle to the axis of said shaft, said brush means being pivoted to oscillate in contact with the carpet, a bearing mounted on said crank portion and means connecting said bearing to said brush means, rotational motion of said shaft being converted to pivotal reciprocation of said brush means through said crank portion, said bearing, and said means connecting said bearing to said brush means, the pivot axis of said brush means, the center line of said bearing and the axis of said shaft substantially intersecting at a common point.

10. A cleaning device as set forth in claim 9, said brush means comprising a transversely extending bar.

* * * * *

UNITED STATES PATENT AND TRADEMARK OFFICE

CERTIFICATE OF CORRECTION

PATENT NO. : 4,272,861

DATED : June 16, 1981

INVENTOR(S) : Adolf Notta; Ian A. Scovell

It is certified that error appears in the above-identified patent and that said Letters Patent are hereby corrected as shown below:

Claim 7, line 2, "adust" should be --adjust--.

Claim 8, line 2, "comprising" should be --comprises--.

Signed and Sealed this

*Seventeenth* Day of *November 1981*

[SEAL]

*Attest:*

GERALD J. MOSSINGHOFF

*Attesting Officer*

*Commissioner of Patents and Trademarks*